United States Patent [19]

Tetenborg et al.

[11] Patent Number: 4,873,815

[45] Date of Patent: Oct. 17, 1989

[54] APPARATUS FOR FILLING AND CLOSING SACKS WHICH ARE OPEN AT ONE END

[75] Inventors: Konrad Tetenborg; Heinz Eschmann; Helmut Hüwelmann, all of Lengerich, Fed. Rep. of Germany

[73] Assignee: Windmoller & Holscher, Lengerich, Fed. Rep. of Germany

[21] Appl. No.: 192,635

[22] Filed: May 11, 1988

[30] Foreign Application Priority Data

May 11, 1987 [DE] Fed. Rep. of Germany ..... 3715684

[51] Int. Cl.[4] ..... B65B 43/26

[52] U.S. Cl. ..... 53/570; 53/373; 53/386; 53/571

[58] Field of Search ..... 53/570, 571, 373, 386

[56] References Cited

U.S. PATENT DOCUMENTS

| | | | |
|---|---|---|---|
| 4,411,296 | 10/1983 | Durant | 53/571 |
| 4,423,583 | 1/1984 | Carey | 53/570 |
| 4,510,736 | 4/1985 | Muller | 53/570 |
| 4,612,965 | 9/1986 | McGregor | 53/571 |

*Primary Examiner*—W. Donald Bray

*Attorney, Agent, or Firm*—Fleit, Jacobson, Cohn, Price, Holman & Stern

[57] ABSTRACT

An apparatus for filling and closing sacks has a pair of grippers for gripping the lateral portions of the sacks adjacent to their opening-defining edges, the grippers of each pair are movable toward and away from each other, also a pair of suction cups for pulling the side walls of the sacks apart adjacent to the opening-defining edges between the grippers, a filling pipe, which is adapted to be lowered into and to be lifted out of the opened sacks, and a welding device for forming a transverse seam weld to close the opening-defining edges when they have been pulled taut by a movement of the grippers away from each other. A transfer conveyor is provided for conveying freely suspended sacks into the region below the filling pipe, pivoted arms are connected to a turning drive carry the grippers and serve to take over the sacks in a position in which the sacks are substantially aligned with the longitudinal axis of the filling pipe, the turning drive pivotally moves the filled sacks in the feeding direction beyond the filling pipe into the welding station and deposits the sacks on a support in the welding station. In the welding station opening-defining edge portions are provided by the welding jaws of the welding device with a transverse seam weld closing the sacks, and the turning drive subsequently imparts to the pivoted arms a pivotal movement to their filling position below the filling pipe so that they can take over and hold the next sack.

11 Claims, 5 Drawing Sheets

APPARATUS FOR FILLING AND CLOSING SACKS WHICH ARE OPEN AT ONE END

BACKGROUND OF THE INVENTION

This invention relates to an apparatus for filling and closing sacks, for example sacks made of thermoplastic sheet material which may be formed with gussets. Apparatus for this purpose may for example, comprise a pair of grippers for gripping lateral portions of the sacks adjacent their opening-defining edges, wherein the grippers of each pair are movable toward and away from each other, a pair of suction cups for pulling the side walls of the sacks apart adjacent the opening-defining edges between the grippers, a filling pipe, which is adapted to be lowered into and lifted out of the opened sacks, and a welding device for forming a transverse weld seam, to close the opening-defining edges, after they have been pulled taut to contact each other by a movement of the grippers away from one another.

Known apparatus of the above kind is commonly provided with a conveyor for conveying the sacks from a first station, (which normally constitutes a feeding station in which the conveyor receives the individual sacks after they have been provided with a bottom seam,) to a filling station, and which in a succeeding conveying step conveys the filled sacks to a welding station, in which the tautened opening-defining edges of the filled sacks are provided with a transverse weld seam. The sacks are usually released by the conveyor in the welding station or in a further conveying step succeeding the welding station and are usually conveyed further by another conveyor. If the sacks consist of paper, a sewing machine for closing the opening-defining edges of the sacks is provided rather than a welding means.

Known apparatus of the kind described usually has an expensive structure, particularly owing to the provision of the conveyor for conveying the sacks through the various stations.

SUMMARY OF THE INVENTION

It is an object of the invention to provide an apparatus of the kind described in which the sacks can be conveyed by simple means from a transfer station to a filling position below a filling pipe and from there to a welding station.

In an apparatus of the kind concerned that object is accomplished in that a transfer conveyor is provided for conveying freely suspended sacks which have been provided with bottom seams into the region below a filling pipe. Pivoted arms are connected to a turning drive and at their free top ends carry grippers which take over the sacks in a position in which the sacks are substantially aligned with the longitudinal axis of the filling pipe. The turning drive pivotally moves the filled sacks in the feeding direction beyond the filing pipe into the welding station and deposits the sacks on a support in the welding station. In the welding station, those opening-defining edge portions of the sacks, which protrude above the grippers and in dependence on the position of the pivoted arms are angled from the longitudinal center plane of the sacks, are provided by the welding jaws of the welding device with a transverse weld seam closing the sacks. The turning drive subsequently imparts to the pivoted arms a return pivotal movement to their filling position below the filling pipe so that the can take over and hold the next sack.

The apparatus in accordance with the invention is distinguished by having a simple and compact structure because a single pair of pivoted arms which are pivoted to the frame at fixed locations and carry the grippers are sufficient for holding the sacks in the filling station below the filling pipe and for subsequently forwarding the sacks to the welding station, in which the opening-defining edges of the sacks, which edges have been pulled to contact each other, are provided with the transverse seam welds closing the sacks. In addition to constituting a simple and rugged structure, the apparatus in accordance with the invention does not comprise the conventional means for clamping the sack to the filling pipe when the sack is to be filled. An effective filling of the sacks is permitted by the fact that the sacks to be filled are held in a freely suspended condition by the pivoted arms so that the sack walls which initially contact each other can expand freely under the pressure applied by the inflowing material to be filled into the sacks. The pivoted arms which are provided in accordance with the invention and carry the grippers ensure that the sacks to be filled will be effectively held and guided throughout their movement from the transfer conveyor as far as to the welding station.

The turning drive for the pivoted arm suitably consists of fluid-operable piston-cylinder units.

In accordance with a further feature of the invention, each gripper is connected to the associated pivoted arm by a pair of links and the grippers are pivotally movable toward and away from each other relative to the pivoted arms by fluid-operable piston-cylinder units. That design permits a simple movement of the grippers toward and away form each other. Before the filling operation the grippers move toward each other so that the filling opening can be pulled open by the suction cups to permit the filling pipe to be introduced.

The inner link of each pair is desirably longer and the pivot points constitute the corners of a trapezoid. For imparting a pivotal movement to the links, one of the links of each pair may be provided at its lower turning shaft with an actuating lever, to which the fluid-operable piston-cylinder unit for moving the gripper is pivoted at one end of said unit whereas the other end of the fluid-operable piston-cylinder unit is pivoted to the associated turning lever.

In accordance with a further feature of the invention each link is pivoted at its top end to a carrier, which is provided with a stationary gripper jaw, and the gripper jaw which is pivotally movable by a fluid-operable piston-cylinder unit is movably mounted on the carrier.

The suction cups for pulling apart the opening-defining edges of the sacks to be filled may be secured to the ends of turning levers, which are pivoted to the frame at fixed locations. Each of the turning levers suitably consists of two links for constraining the suction heads to move in parallel.

In accordance with a further feature of the invention, the support consists of a conveyor belt for intermittently removing the filled sacks. The conveyor belt is intermittently advanced by respective conveying steps whenever the pivoted arms perform a pivotal movement from the filling station to the welding station and deposit the filled sack onto the conveyor belt so that the upright position of the sack will be maintained.

The conveyor belt is suitably provided with backrest-like backing flights, with a spacing that corresponds to the length of a conveying step and which hold the filled sacks in an upright position.

In accordance with a further feature of the invention the control of the drive means for the transfer conveyor and the control of the drive means for the belt conveyor are so matched that the sack to be filled has been pivotally moved below the filling pipe while the sack has been substantially steadily suspended before the conveyor belt is advanced by one conveying step. This will prevent the sack, which consists of limp material, from bearing in an inclined position on the outside of a backing flight because such a support of the sack in an inclined position might give rise to disturbances in that the sack is no longer able to assume during the filling operation a position below the filling pipe between two backing flights of the conveyor belt.

In accordance with a further feature of the invention rapping plates, which are adapted to be lifted and lowered, are provided on both sides of the backrestlike backing flights above the upper course of the conveyor belt in the region below the filling pipe and impart rapping blows to the bottom portion of the sack as it is freely suspended from the pair of grippers during the filling operation. Each rapping plate may be secured to two links by means of arms which are angled from the rapping plate and said two links may be pivoted to the frame at fixed locations at their other ends. One end of a rapping cylinder may be pivoted to one of the links whereas the other end of said cylinder may be movably mounted on the frame at a fixed location.

Figure 1:
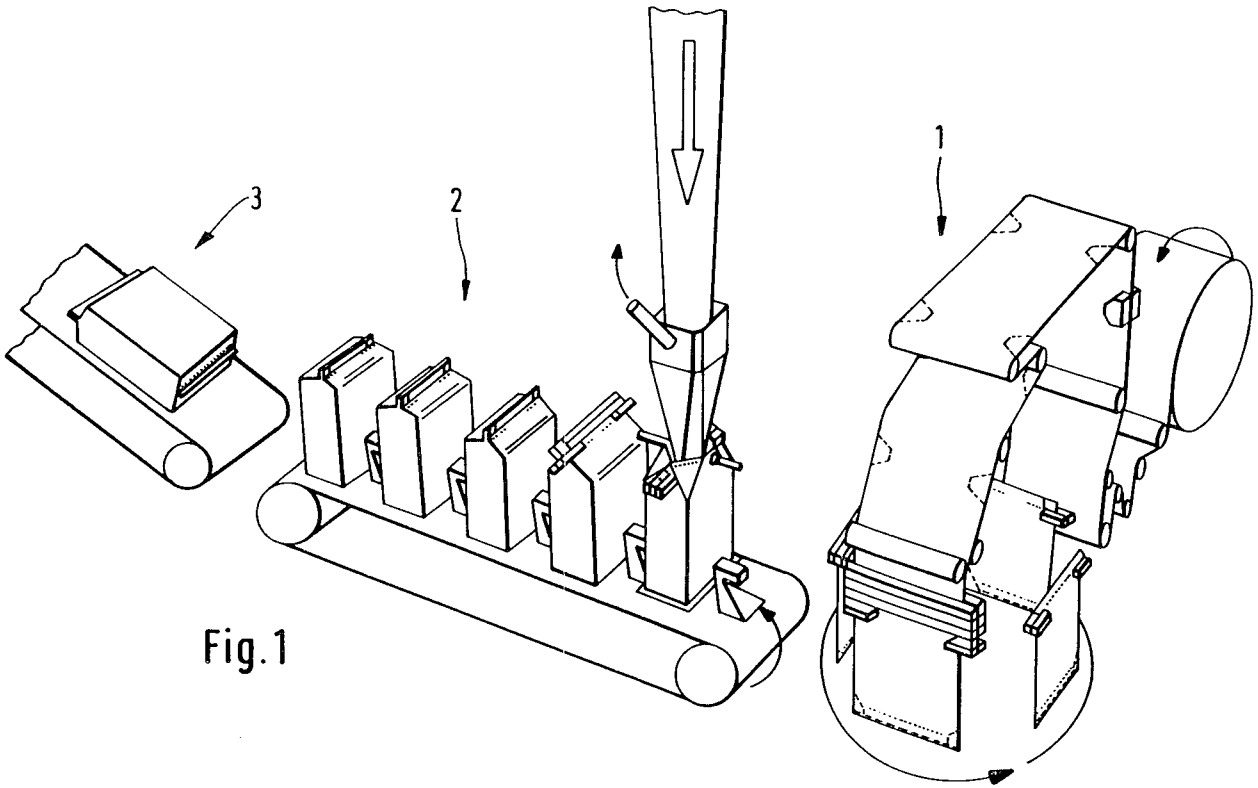
FIG. 1 is a diagrammatic perspective view of an apparatus for filling and closing sacks, disposed between an apparatus for making the sacks and a conveyor belt for carrying off the filled sacks.

Those parts of the apparatus not required for an understanding of the invention have been omitted in the drawings.

DETAILED DESCRIPTION OF PREFERRED EMBODIMENT

An illustrative embodiment of the invention will now be explained in detail with reference to the drawing.

FIG. 1 shows a plant for making sacks, filling the sacks with material, and carrying off the filled sacks. The plant comprises an apparatus 1, in which sacks are made from a gusseted continuous tubular film that has been wound to form a roll, and in which the sacks are caused to perform a gyratory movement in a so-called cooling turret and are then transferred by transfer grippers, not shown, to the apparatus 2 for filling and closing the sacks. The apparatus 2 for filling and closing the sacks is the subject matter of the present invention. In the apparatus 2 the sacks are filled on a conveyor which is provided with backing flights, and the sacks are subsequently provided with weld seams for closing the sacks at their opening-defining edges. From the conveyor the sacks are delivered to a forwarding conveyor belt 3.

The apparatus for filling and closing the sacks will now be described more in detail with reference to FIGS. 2 to 7.

The gusseted sacks 11 shown in the apparatus 1 are moved in the direction indicated by the arrow A (FIG. 2) to a transfer position below a filling pipe 12 by a transfer conveyor, which is not shown in FIG. 1 and indicated only by the gripping jaws 4 in FIG. 2. In the transfer position, the sacks are taken over by grippers 6, 6', (FIG. 3) which are mounted on pivoted arms 5, 5'. The grippers grip the freely suspended sacks on mutually opposite sides adjacent the opening-defining edges of the sacks. When the transfer conveyor has released the sacks, the transfer conveyor returns on tracks, not shown, to its outer position, in which the transfer conveyor takes over the next sack 11 that is to be transferred to the pivoted arm. The transfer conveyor does not form a part of the present invention and its structure will be apparent to those skilled in the art.

The arms 5, 5' are pivoted to pivot pins 8, 8', which are secured to side frames 7, 7' of the machine frame and which are aligned with each other. Levers 9 are secured to the pivoted arms 5, 5' adjacent to the pivot pins 8, 8' and said levers are pivoted at their free ends to the piston rods of fluid-operable cylinder-piston units 10. The cylinders of said units are pivoted to the frame at fixed locations as is shown in FIG. 2. The fluid-operable piston-cylinder units 10 are so controlled that the pair of grippers 6, 6' carried by the pivoted arms 5, 5' take over each sack 11 from the transfer conveyor 4 when the sack is disposed below the filling pipe 12 and hold the sack freely suspended in the filling station until the sack has been filled. The arms 5, 5' subsequently impart to the filled sack a pivotal movement in the direction indicated by the arrow B so as to deposit the sack onto the conveyor belt 14, which is provided with the backing flights 13. At the same time the conveyor belt 14 is advanced through one conveying step, by a drive not shown, so that the welding jaws 15, 16 which cooperate like tongs, can provide each sack 11 with a transverse weld seam to close the sack at its opening-defining edge portion, which has been pulled flat.

Figure 3:
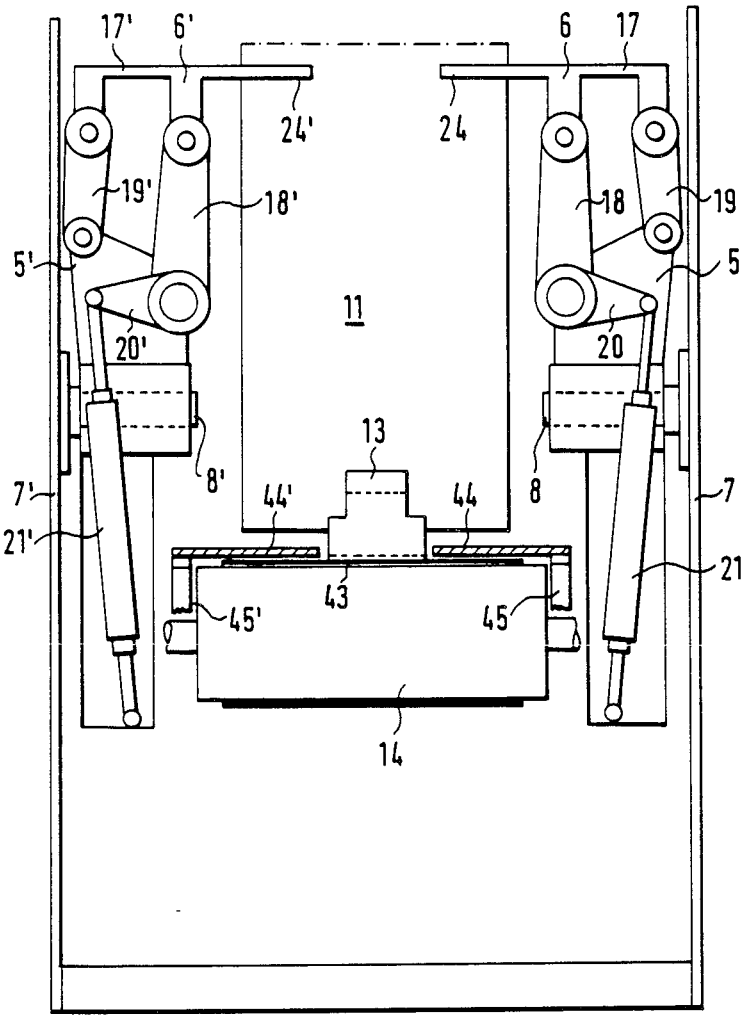
FIG. 3 is a front elevation of the apparatus of FIG. 2.

Each of the grippers 6, 6' comprises a carrier 17, 17', which is pivoted to the top ends of links 18, 19 and 18', 19', which at their bottom ends are pivoted to the turning levers 5, 5' in the manner shown in FIG. 3. The longer, inner links 18, 18' are provided near their lower pivots with outwardly extending actuating levers 20, 20', which at their free ends are pivoted to the piston rods of fluid-operable piston cylinder units 21, 21', the cylinders of which are pivoted to the lower portions of the turning levers 5, 5'. Said turning levers 5, 5' constitute mounting portions, which extend beyond the pivot pins 8, 8'. The fluid-operable piston-cylinder units 21, 21' can be operated simultaneously under the control of suitable control means, not shown, so that the gripping tongs 6, 6' of the pair of grippers can be moved toward and away form each other widthwise of a sack in such a manner that links 18, 19, 18', 19' will hold the grippers substantially parallel to themselves during the pivotal movement.

The carriers 17, 17' of the grippers are provided with fingerlike gripping jaws 24, 24', which extend toward each other. Pivoted backing jaws 6a (not shown in FIG.

Figure 2:
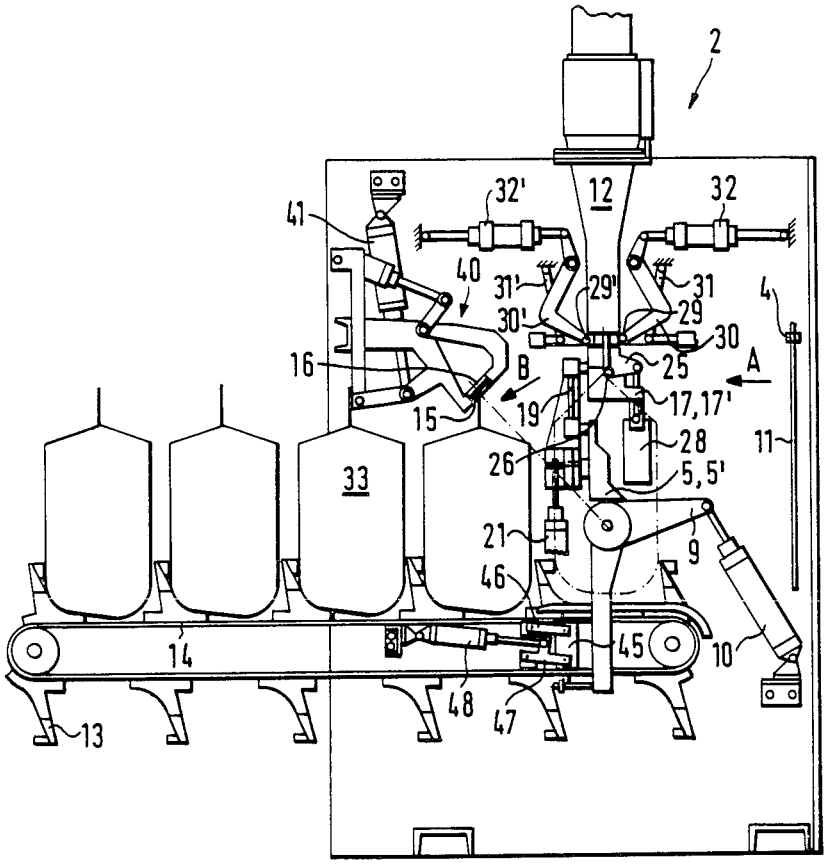
FIG. 2 is a side elevation showing the apparatus of FIG. 1 for filling and closing the sacks.
Figure 5:
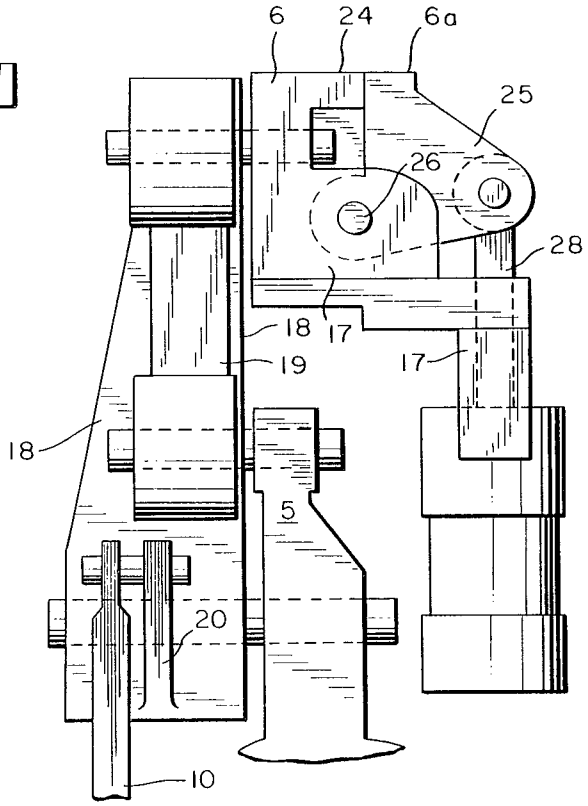
FIG. 5 is a more detailed side elevational view of the gripper assembly.
Figure 4:
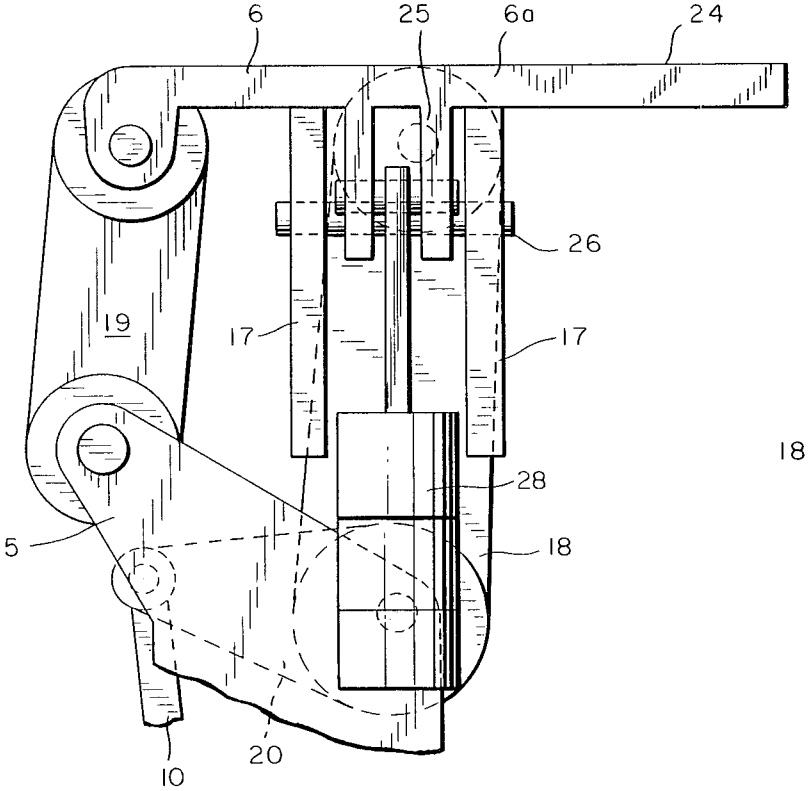
FIG. 4 is a more detailed rear elevational view of a gripper assembly viewed in a direction opposite the direction of FIG. 3.
Figure 6:
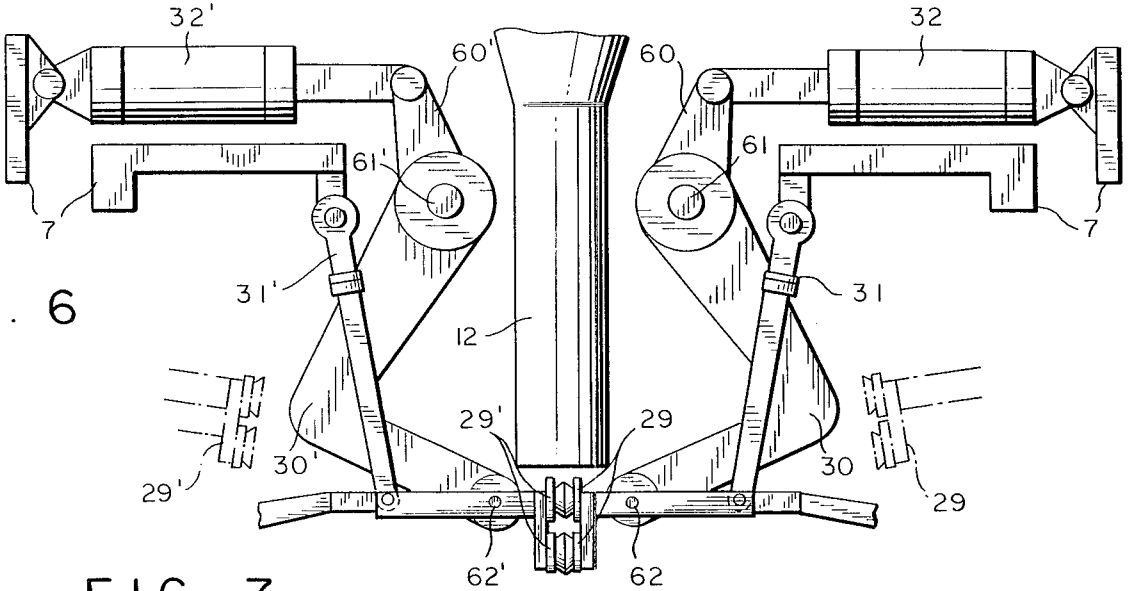
FIG. 6 is a more detailed side elevational view of a suction cup assembly and operating linkage.
Figure 7:
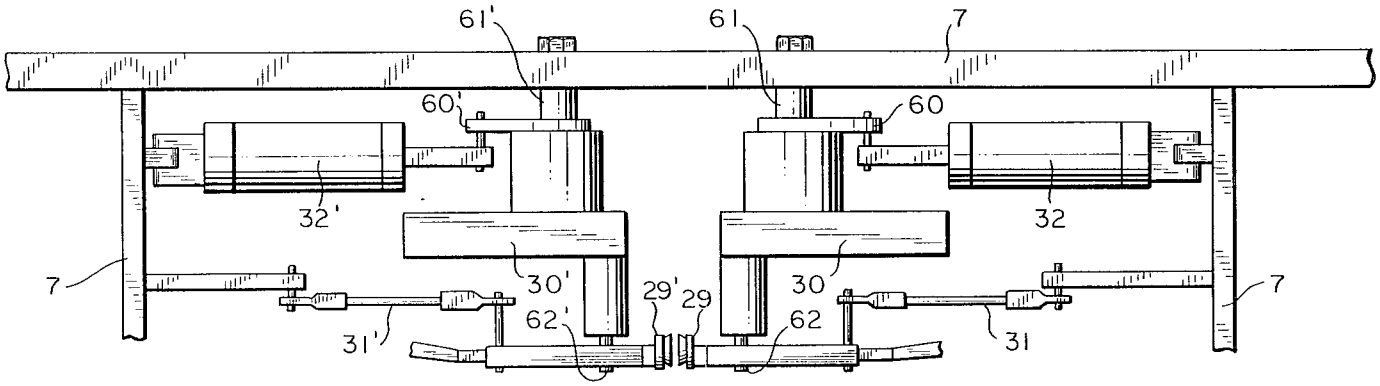
FIG. 7 is a plan view of the suction cup assembly and operating linkage.

3) are also fingerlike and are secured to bell-crank levers, which near their bends are pivoted to the carriers 17, 17' in the manner shown in FIGS. 2 and 5. As is also shown in FIGS. 2 and 5 the bellcrank levers 25 are pivoted to the piston rods of fluid-operable piston-cylinder units 28, the cylinders of which are secured at their top ends by suitable connectors to the carriers 17, 17'.

When a sack 11 that is to be filled has been pivotally moved by the pivoted arms 5, 5', to a portion under the filling pipe 12 and the grippers 6, 6' have been moved toward each other, the suction cups 29, 29' pull the opening-defining edges apart between the gripping jaws of the grippers, which jaws cooperate like tongs. As a result, the filling tube can be introduced into the opening between the separated opening-defining edges in the manner shown in FIG. 1.

To ensure that the suction cups 29, 29' will move parallel to each other, they are carried by pivotally interconnected links 30, 31 and 30', 31', which are themselves pivoted to the frame at fixed locations. The links are laid pivotally interconnected by pins 62, 62'. As is apparent form FIGS. 2 and 6 the links 30, 30' are provided with operating levers 60, 60' near their pivotal connections 61, 61' to the frame and the free ends of said levers are pivoted to fluid-operable piston-cylinder units 32, 32'.

During the filling operation the sack 33 is held by the grippers so that the sack is freely suspended, as is indicated in phantom in FIG. 2. The filled sack 33 is deposited by the pivoted arms 5, 5' on the conveyor belt 14 and the gripping tongs 6, 6' are moved apart at the same time so that the opening-defining edges are pulled to contact each other. Those opening-defining edge portions of the sack 33 which protrude over the gripping tongs 6, 6' are then joined by welding by means of the welding jaws 15, 16 of the welding device 40. The entire welding device is pivoted in the frame on an axis which is transverse to the conveyor belt 14. The welding device can be pivotally raised by the fluid-operable piston-cylinder unit 41 so that the filled and closed sacks which have been released by the welding jaws 15, 16 will not be obstructed as they are carried off by the conveyor belt 14 under the welding device 40.

On both sides of the backrestlike backing flights 13, reciprocating plates 44, 44' are provided above the upper course 43 of the conveyor belt 12 and are provided with angled arms 45, 45'. Parallel-motion links 46, 47 are pivoted at one end to the arms 45, 45' and at their other end are pivoted to frame at fixed locations. As is shown in FIG. 2 the link 47 is provided with a leverlike extension, which at its free end is pivoted to the piston rod of fluid-operable piston cylinder unit 48, the cylinder of which is pivoted to the frame. As is apparent from FIG. 2, a reciprocating motion of the piston rod of the fluid-operable cylinder-piston unit 48 will impart an up-and-down motion to the plates 44, 44' so that the latter impart blows to the bottom portion of the sack which is freely suspended in the filling station.

What is claimed:

1. An apparatus for filling and closing sacks comprising means defining a sack filling station and means defining a sack welding station, a transfer conveyor having means for conveying sacks in a freely suspended condition into the filling station, spaced pivoted arms in the filling station having free ends with grippers for taking sacks over from the transfer conveyor and gripping opposite upper ends of a sack, a pair suction cups in the filling stations for pulling side walls of the sacks apart adjacent upper edges thereof between the grippers, a filling pipe in the filling station, means for lowering the filling pipe into a sack when said walls have been pulled apart for filling the sack and for lifting the pipe from the sack, a turning drive for rotating said arms to move a sack from the filling station to the welding station and for returning the arms to the filling station, actuating means for closing the grippers to grip a sack at the filling station and for opening the grippers at the welding station, and welding jaws at the welding station for forming a weld adjacent said upper edges of a sack prior to opening of the grippers.

2. An apparatus according to claim 1, wherein the turning drive for the pivoted arms consists of fluid-operable piston-cylinder means.

3. An apparatus according to claim 1, characterized in that the suction cups for pulling apart the opening-defining edges of the sacks to be filled are secured to the ends of turning levers, which are pivoted to a frame at fixed locations.

4. An apparatus according to claim 3, characterized in that each of the turning levers associated with the suction cups consists of two links.

5. An apparatus according to claim 1, characterized in that the support consists of which includes belt conveyor extending below the filling station and welding station for intermittently carrying off filled sacks.

6. An apparatus according to claim 5, characterized in that the belt conveyor is provided with backrestlike backing flights, which have a spacing there between that corresponds to the length of a conveying step, for holding the filled sacks in an upright position.

7. An apparatus according to claim 5, characterized in that the welding jaws are respectively secured to and movably mounted on a pivotal carrier, and means is provided for pivotally raising the carrier so that sacks standing on the conveyor belt can be carried off without obstruction by the welding jaws.

8. An apparatus according to claim 6, characterized by reciprocation plates, provided on both sides of the backrestlike backing flights above an upper course of the belt conveyor belt in a region below the filling pipe for imparting blows to a bottom portion of a sack white suspended from the grippers during a filling operation.

9. An apparatus according to claim 1, wherein the grippers are connected to the respective arms by link mechanisms for moving the grippers toward one another for opening the sack and away from one another for closing the sack.

10. An apparatus according to claim 9, wherein each link mechanism comprises an inner link and an outer link, the inner link and the outer link each being pivotally connected to the respective arm and the respective gripper.

11. An apparatus according to claim 10, wherein the inner link is longer than the outer link and wherein each arm has a piston-cylinder assembly for pivoting the inner link to move the respective grippers toward and away from one another.

* * * * *